US006019585A

United States Patent [19]

Abelen et al.

[11] Patent Number: 6,019,585

[45] Date of Patent: Feb. 1, 2000

[54] OIL-SEALED VANE-TYPE ROTARY VACUUM PUMP WITH OIL FEED

[75] Inventors: Thomas Abelen; Peter Muller, both of Cologne, Germany

[73] Assignee: Leybold Vakuum GmbH, Cologne, Germany

[21] Appl. No.: 08/983,538

[22] PCT Filed: Jul. 12, 1996

[86] PCT No.: PCT/EP96/03078

§ 371 Date: Jan. 14, 1998

§ 102(e) Date: Jan. 14, 1998

[87] PCT Pub. No.: WO97/04236

PCT Pub. Date: Feb. 6, 1997

[30] Foreign Application Priority Data

Jul. 19, 1995 [DE] Germany ..... 195 26 303

[51] Int. Cl.[7] ..... F01C 21/04

[52] U.S. Cl. ..... 418/88; 418/93; 418/98; 418/269

[58] Field of Search ..... 418/88, 93, 98, 418/269; 417/281

[56] References Cited

U.S. PATENT DOCUMENTS

| | | | |
|---|---|---|---|
| 4,276,005 | 6/1981 | Bassan | 418/88 |
| 4,844,702 | 7/1989 | Ceccherini et al. | 418/88 |
| 5,236,313 | 8/1993 | Kim | 417/281 |

FOREIGN PATENT DOCUMENTS

| | | |
|---|---|---|
| 406873 | 1/1991 | European Pat. Off. . |
| 2155583 | 4/1973 | France . |
| 2158517 | 4/1985 | Germany . |
| 256540 | 5/1988 | Germany . |

*Primary Examiner*—Thomas Denion
*Assistant Examiner*—Thai-Ba Trieu
*Attorney, Agent, or Firm*—Wall Marjama Bilinski & Burr

[57] ABSTRACT

The invention concerns an oil-sealed vane-type rotary vacuum pump with a suction chamber (8) housing a rotatably mounted rotor (3) which has an anchoring section (21) and a bearing section (23) with a slot (24) in which two vanes (26) are mounted with a space (28) between them. The rotor bearing (3) comprises the bearing section (23) and a rotor-mounting bore (11). The vacuum pump also has an oil pump (45, 46), which produces a flow of oil through the space (28) between the vanes, and a system for controlling the flow of oil through the space (28), the oil passing through a channel (66) opening out in the rotor-mounting bore (11) and then through radial and longitudinal bores (68, 69) in the bearing section (23) of the rotor. In order to reduce the noise produced by the pump when in operation, the invention proposes that the location where the oil channel (66) opens out into the rotor-mounting bore (11) and the location of the radial bore (68) in the bearing section (23) of the rotor, with respect to the location of the vanes (26) or the vane-mounting slot (24), are such that oil can only flow into the space (28) between the vanes when the volume of the space is increasing, and that there is a permanently open line leading to the vacuum-suction chamber (8) for the oil leaving the space (28) between the vanes. (Drawing FIG. 1)

9 Claims, 2 Drawing Sheets

OIL-SEALED VANE-TYPE ROTARY VACUUM PUMP WITH OIL FEED

BACKGROUND OF THE INVENTION

The invention concerns an oil-sealed vane-type rotary vacuum pump with the characteristics of patent claim 1.

A vacuum pump with the characteristics of patent claim 1 is known from DD-A-256540. Laid open in this publication is a single-stage vane-type rotary vacuum pump, the rotor of which is suspended at both its ends by means of a journal bearing. The two journals as well as the related bearing sections are equipped with bores which are so formed and arranged that they act like cocks which control the entry and discharge of an excess oil flow passing through the space between the vanes. The arrangement, or the way in which the bores are assigned, is so selected that the oil enters the space between the vanes via the first journal when the space has attained its greatest volume. During this phase, and also during the subsequent phase during which the volume of the intermediate space reduces, the discharge of oil in the direction of the oil sump is blocked. Thus an increased oil pressure builds up in the space between the vanes, so that oil may enter into the suction chamber through slots which are present between the vanes and the slots in the vanes and in the area of the face sides of the rotor so that said suction chamber is supplied with the necessary sealing and lubricating oil. Shortly before the space between the vanes attains its smallest volume, the oil discharge ahead of the second journal is opened. Owing to the pumping action of the space between the vanes, the excess oil is ejected and is returned to the oil sump.

SUMMARY OF THE INVENTION

This solution according to the state-of-the-art has the disadvantage, that the way in which the oil is supplied into the suction chamber is not defined since it is effected via slots which are subject to manufacturing tolerances and which are subject to wear. Moreover, the known solution requires the presence of journals on both sides of the rotor. In the case of a cantilevered rotor, this state-of-the-art solution can not be implemented. Finally, ever so often high oil pressures will build up briefly in the space between the vanes, which give rise to considerable noise (oil slap).

It is the task of the present invention to design a vane-type rotary vacuum pump of the aforementioned kind, in which noises due to oil slap are mostly avoided.

According to the present invention this task is solved through the characteristic features of patent claim 1. In a vacuum pump designed according to the present invention, oil passes into space between the vanes when the space increases in volume. Moreover, the link linking the space between the vanes and the suction chamber is permanently open. Thus an increased oil pressure can not build up. During the phase of decreasing volume of the space between the vanes, no oil is admitted so that the pumping effect of the space between the vanes can not have an influence on the oil flow. Oil slap will not occur. The quantity of oil which enters into the space between the vanes is adjustable through the size of the bores in the casing and the bearing section, the openings of which oppose each other briefly during each turn of the rotor. The size of the bores may be selected in a simple manner so that only exactly that quantity of oil is admitted into the space between the vanes, and thus into the suction chamber, which will be sufficient to meet the vacuum engineering requirements of the pump, while at the same time taking into account the requirements of the application, for example. It is important that the oil entering the suction chamber be unpressurerized. From there it passes via the discharge of the pump back to the oil sump. Finally, only one bearing journal suffices to control the oil flow in the space between the vanes, so that the present invention may also be utilised in vacuum pumps having a cantilevered rotor.

A further reduction in the noises which occur during operation can be obtained by supplying into the space between the vanes a mixture of oil and air. This mixture may be produced ahead of, or in the oil pump.

Preferably the point of time at which the oil is admitted into the space between the vanes is so selected that it has attained its smallest volume at the moment the oil is admitted. This reliably prevents the occurrence of oil slap.

BRIEF DESCRIPTION OF THE DRAWINGS

Moreover, it is advantageous that the oil be injected into the space between the vanes with the aid of a nozzle. This ensures a reliable lubricating effect while at the same time keeping the quantity of circulating oil small.

Further advantages and details of the present invention shall be explained by referring to drawing FIGS. 1 to 2. Shown in

- drawing

DESCRIPTION OF THE INVENTION

Figure 1:
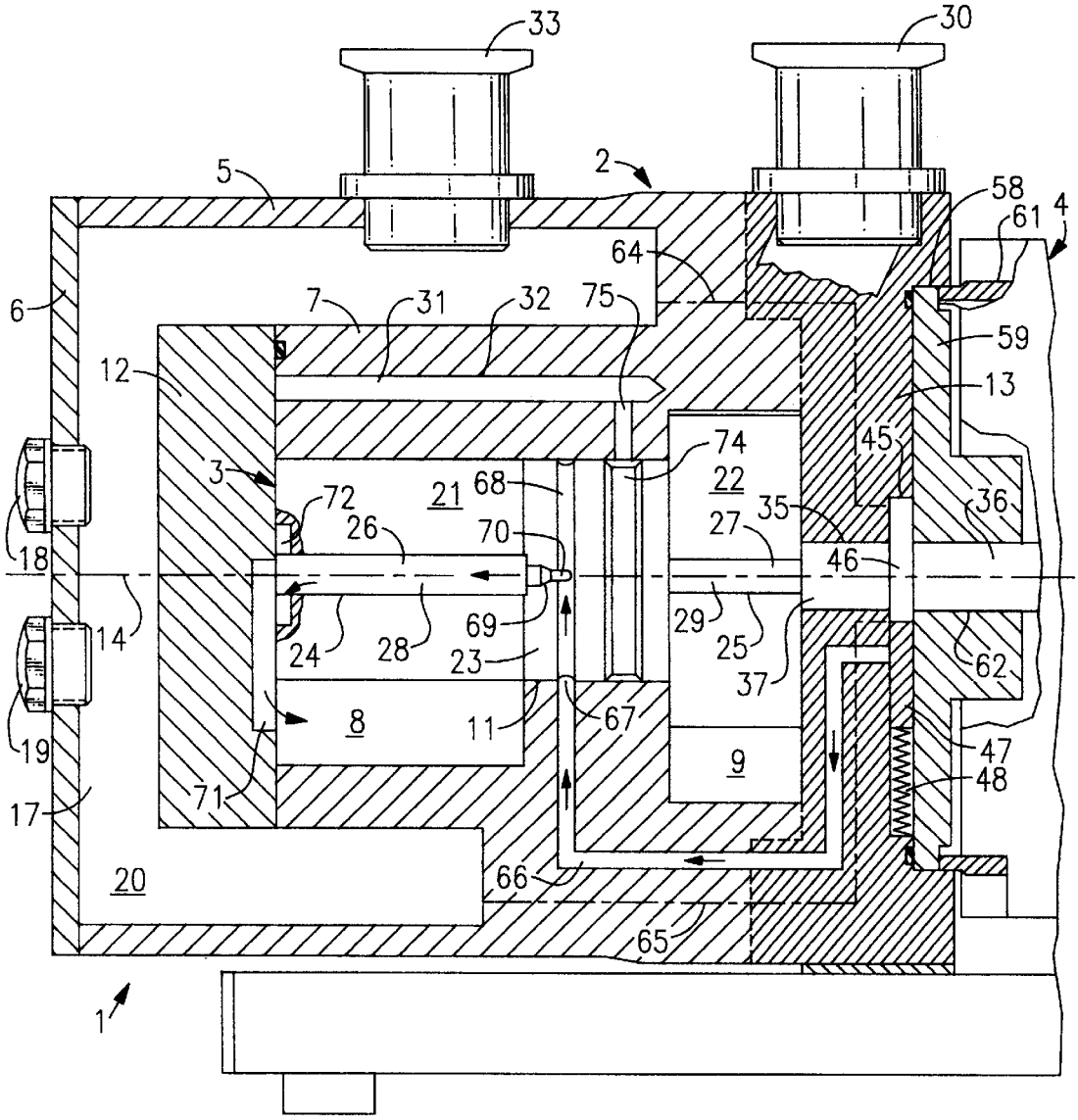
FIG. 1 is a longitudinal section through a design example for a two-stage vane-type rotary vacuum pump according to the present invention and
- drawing FIG. 2 a schematic section through a single-stage vane-type rotary vacuum pump according to the present invention.

The presented pump 1 comprises the subassemblies casing 2, rotor 3 and drive motor 4.

The casing 2 has substantially the shape of a pot with an outer wall 5, with the lid 6, with an inner section 7 and the suction chambers 8, 9 as well as rotor-mounting bore 11, with end section 12 and bearing section 13 which complete suction chambers 8, 9 at their face sides. The axis of the rotor-mounting bore 11 is designated as 14. Located between outer wall 5 and inner section 7 is the oil chamber 17, which during operation of the pump is partly filled with oil. Two oil level glasses 18, 19 (maximum, minimum oil level) are provided in lid 6 for checking the oil level. Oil fill and oil drain are not shown. The oil sump is designated as 20.

Located within the inner section 7 is the rotor 3. It is designed as a single part and has two anchoring sections 21, 22 on the face side and a bearing section 23 located between anchoring sections 21, 22. The anchoring sections 21, 22) are equipped with slots 24, 25 for two vanes 26, 27. The presentation according to drawing FIG. 1 is so selected that the respective spaces between the vanes 28, 29 are placed in the plane of the drawing figure. The vane-mounting slots 25, 26 are each milled from the corresponding face side of the rotor so that precise slot dimensions can be attained in a simple manner. The bearing section 23 is located between anchoring sections 21, 22. Bearing section 23 and rotor-mounting bore 11 form the only bearing for the rotor.

Anchoring section 22 and the related suction chamber 9 have a greater diameter compared to anchoring section 21 with the suction chamber 8. Anchoring section 22 and suction chamber 9 form the high vacuum stage. During operation, the inlet of the high vacuum stage 9, 22 is linked to the intake port 30. The discharge of the high vacuum stage 9, 22 and the inlet of the forevacuum stage 8, 21 are linked via casing now channel 31, which extends in parallel to the axes of the suction chambers 8, 9. The discharge of the forevacuum stage 8, 21 opens into the oil chamber 17. There the oil containing gases quieten down and leave the pump 1 through the discharge port 33. For reasons of clarity the inlet and discharge openings of the two pumping stages are not shown in drawing FIG. 1. The casing 2 of the pump is preferentially assembled from as few parts as possible. At least the two suction chambers 8, 9 and the wall sections 5, 7 surrounding the oil chamber 17, should be made of a single piece.

Coaxial with axis 14 of the rotor-mounting bore 11, the bearing section 13 is equipped with a bore 35 for a rotor drive. This rotor drive may consist directly of the shaft 36 of the driving motor 4. In the design example presented in drawing FIG. 1, a coupling piece 37 is provided between the free face side of the driving shaft 36 and the rotor 3. The way in which the coupling piece 37 is coupled to the driving shaft 36 on the one hand and the rotor on the other hand is not described in detail. This is explained in DE-A-43 25 285 in greater detail.

The presented pump is equipped with an integrated oil pump. This consists of the suction chamber 45 embedded in the bearing section 13 from the side of the motor and the oval eccentric 46 rotating in said suction chamber. In contact with the eccentric is a stopper 47 which is tensioned by spring 48. The eccentric 46 of the oil pump is part of the coupling piece 37. It is linked either firmly or by a positive fit—with axial play only—to the coupling piece 37.

In the presented design example with oil pump 45, 46, the bearing section 13 is equipped on its side which faces the motor 4 with a circular recess 58 in which a disc 59 is located. This disc is maintained in place by the casing 61 of the driving motor 4. Said disc is equipped with a central bore 62, which is penetrated by the shaft 36 of the driving motor 4. Moreover, it is the task of the disc 59 to limit the suction chamber 45 of the oil pump 46.

Air from the oil chamber 17 is supplied via a first channel 64, and oil from the oil sump 20 is supplied via a second channel 65 to the oil pump 45, 46. The mixture of air and oil exiting the oil pump enters into channel 66 which opens into the rotor-mounting bore 11 (opening 67). At the level of opening 67, the bearing journal 23 is equipped with a radial oil through-hole 68 from which a longitudinal bore 69 with a nozzle 70 branches off in the direction of the space between the vanes 28. The position of the opening 67 of channel 66 on the one hand, and the opening of the radial bore 68 in the bearing journal 23 on the other hand, is so selected that oil from channel 66 can only briefly enter into bore 68 when the vanes 26 attain their T-position (c.f. drawing FIG. 2). If the radial oil hole 68 fully penetrates the bearing journal 23, there exist two openings, so that each time when the vanes attain their T-position a link is provided to oil pump 45, 46. During each turn of the rotor 3, the vanes 26 attain this T-position twice. In this position the space between the vanes 28) has its smallest volume. The mixture of oil and air which is injected by the nozzle briefly into the space between the vanes 28 flows through the space between the vanes 28 and enters into suction chamber 8 without being pressurized. For this, the inside of the lid 12 is equipped with a groove 71 which extends from the space between the vanes 28 into the suction chamber 8. In order to ensure that the space between the vanes 28 is permanently linked to the suction chamber 8, the free face side of anchoring section 21 is additionally equipped with a turned groove 72.

If the vacuum pump designed according to the present invention is a single-stage pump, then the significant share of the mixture of oil and air will flow via the bores 66, 68, 69 into the space between the vanes 28 and into the suction chamber 8, and from there it will return to the oil chamber 17. Only a very small share of the oil will enter into the bearing slot between rotor-mounting bore 11 as well as bearing journal 23 supplying this bearing with lubricating oil. It flows through the bearing slot and then also enters into the suction chamber 8. If the vacuum pump is—as presented in the design example according to drawing FIG. 1—of the two-stage type, then a third partial flow of mixed oil and air will enter into the bearing slot of bearing 11, 23 in the direction of the high vacuum stage 9, 22. Would the mixture of oil and air enter the high vacuum stage, then the air contained in the oil would impair the ultimate pressure characteristic of the vacuum pump. Therefore, a degassing step is performed along the passage from the opening 67 of channel 66 to suction chamber 9 of the high vacuum stage. For this, the bearing journal 23 is equipped with a circular groove 74 at the level at which a bore 75 opens which is linked with the intermediate vacuum (bore 31).

Figure 2:
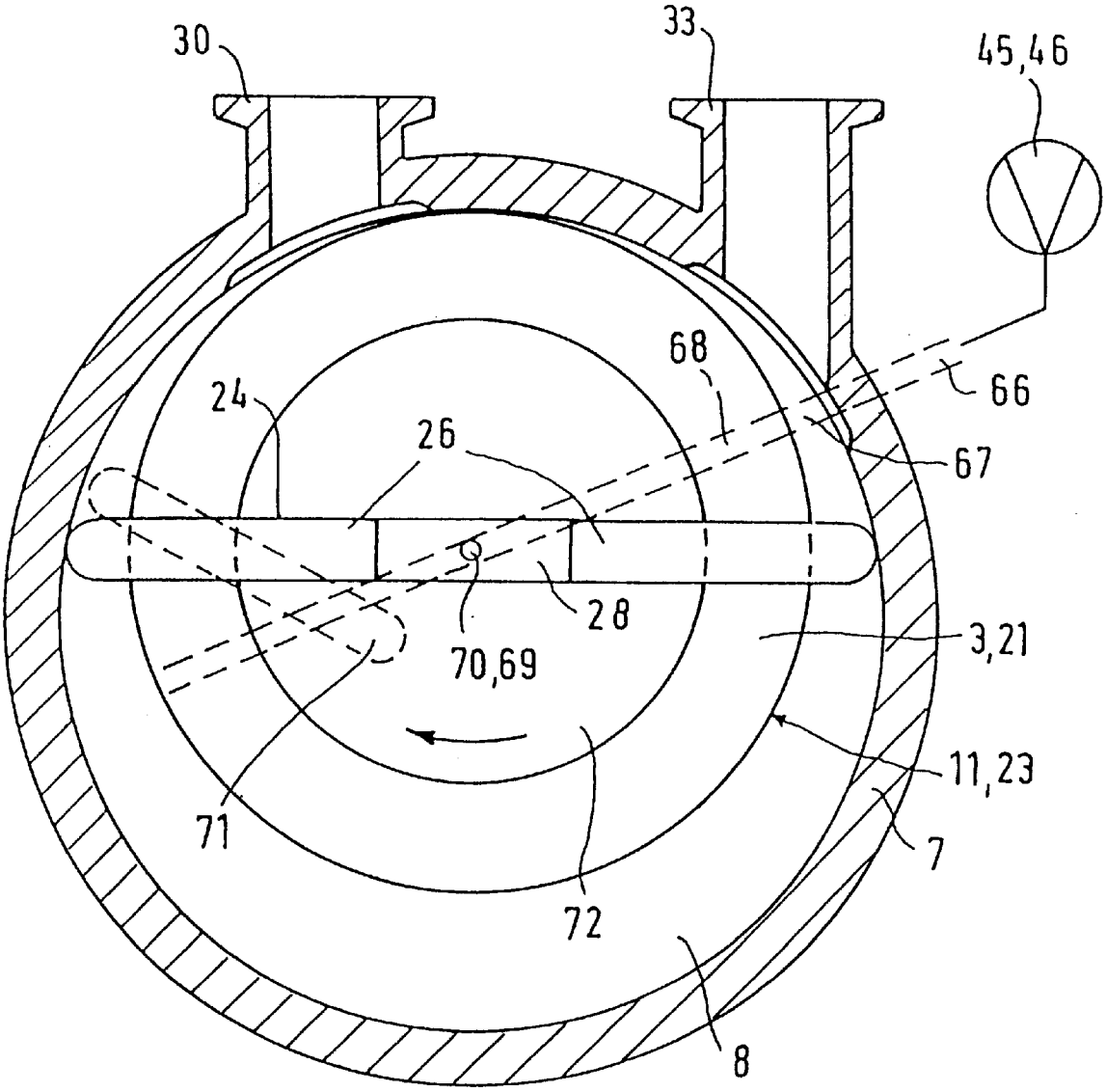

The sectional view through a single-stage pump according to drawing FIG. 2 reveals further details. The mixture of oil and air passes from the oil pump 45, 46, which is symbolically represented, through the channel 66 to opening 67 in the rotor-mounting bore 11. The rotor 3 is shown in a position at which the vanes 26 attain their T-position. In this position, there exists a link between channel 66 in the casing and the radial bore 68 in the bearing section 23. A small, but just sufficient quantity of oil passes via the bores 68, 69 (with nozzle 70) into the space between the vanes 28, which attains is smallest volume while in the T-position.

The groove 71 in the lid 12 opposite the bearing section 23 is indicated by a dashed line. It is located in the vicinity of the discharge 30, so that one of the vanes 26 is at all times placed between inlet 33 and the groove 71. Its inner end extends far into the area of the turned groove 72 in rotor 3, so as to ensure that oil may exit the space between the vanes 28 without pressurization, and may enter into the suction chamber 8 via turned groove 72 as well as groove 71.

It is claimed:

1. An oil sealed vane type vacuum pump having a rotor assembly rotatably mounted within a stationary casing, said rotor assembly including an anchor section mounted within a suction chamber provided within said casing and a bearing section mounted within a bore provided in said casing, said anchor section having a pair of opposed vanes slidably mounted within a slot so that the opposing ends of the vanes are separated by a space within the slot that increases and decreases in volume as the rotor turns and an oil pump for supplying oil to the space between the vanes, said vacuum pump further including an oil channel in said casing for delivering oil from the oil pump into the bearing section of the rotor assembly, said bearing section containing a radially extended oil hole that periodically opens into said oil channel as the rotor assembly turns to admit oil into the bearing section, an opening in said oil hole that is in fluid flow communication with the space between the vanes, said oil channel being located in the casing with respect to the rotor assembly such that oil is admitted into the space between the vanes only when the volume in the space is increasing, and linking means leading from the space between the vanes into the suction chamber, said linking means being always open whereby oil in the space between the vanes is not pressurized as the rotor assembly turns.

2. The vacuum pump of claim 1 wherein the location of the oil channel and the radially extended oil hole in the bearing section are arranged so that oil is admitted into the space between the vanes when the volume of the space is at a minimum.

3. The vacuum pump of claim 1 that further includes a nozzle means for admitting oil from said oil hole into said spaces between the vanes.

4. The vacuum pump of claim 1 wherein said linking means includes an end lid mounted over the suction chamber and a groove formed in the lid for connecting the space between the vanes and the suction chamber.

5. The vacuum pump of claim 4 wherein said anchor section facing the end lid has a circular cut out that connects the space between the vanes and the groove in the lid.

6. The vacuum pump of claim 1 wherein the radially extended oil hole is open at each end whereby oil is admitted to the space between the vanes twice during each revolution of the rotor assembly.

7. The vacuum pump of claim 1 wherein said oil pump has a first supply line for providing oil to the oil pump and a second supply line for providing a gas to the oil pump.

8. The vacuum pump of claim 1 wherein the rotor assembly includes a first anchor section containing a forevacuum stage mounted on one side of the bearing section and a second anchor section containing a high vacuum stage mounted on the other side of the bearing section and degassing means arranged to act upon oil moving from the oil hole toward the high vacuum stage.

9. The vacuum pump of claim 8 wherein the bearing section contains a circular groove which communicates with a flow channel in the casing that extends between an outlet in the high vacuum stage and an inlet in the forevacuum stage.

* * * * *